US006510715B1

(12) United States Patent
Simsek

(10) Patent No.: US 6,510,715 B1
(45) Date of Patent: Jan. 28, 2003

(54) SMART BALANCING SYSTEM

(76) Inventor: Tulga Simsek, 2036/3 Sonak No. 36, Abekent Bostan, 35540 Izmir (IL)

( * ) Notice: Subject to any disclaimer, the term of this patent is extended or adjusted under 35 U.S.C. 154(b) by 0 days.

(21) Appl. No.: 09/673,211

(22) PCT Filed: Apr. 14, 1999

(86) PCT No.: PCT/TR99/00018

§ 371 (c)(1),
(2), (4) Date: Dec. 12, 2000

(87) PCT Pub. No.: WO99/53130

PCT Pub. Date: Oct. 21, 1999

(30) Foreign Application Priority Data

Apr. 14, 1998 (TR) ..... 98/673

(51) Int. Cl.[7] ..... D06F 37/22
(52) U.S. Cl. ..... 68/12.06; 68/23.2; 74/573 F
(58) Field of Search ..... 68/12.06, 23.2; 210/144; 74/573 F

(56) References Cited

U.S. PATENT DOCUMENTS 2,463,801 A * 3/1949 Page ..... 74/573 F
2,760,383 A * 8/1956 De Moss ..... 74/573 F
2,886,979 A * 5/1959 Baxter ..... 74/573 F
4,002,086 A * 1/1977 Reinhall ..... 74/573 F
4,905,419 A * 3/1990 Makarov et al. ..... 74/573 F
4,928,548 A * 5/1990 Lulay ..... 74/573 F
5,197,352 A * 3/1993 Haikawa ..... 74/573 F
5,280,660 A * 1/1994 Pellerin et al. ..... 68/12.06
5,671,494 A 9/1997 Civanelli et al.
5,829,084 A * 11/1998 Fujiwara ..... 68/12.06

FOREIGN PATENT DOCUMENTS

EP 0704567 A1 4/1996

* cited by examiner

*Primary Examiner*—Philip Coe
(74) *Attorney, Agent, or Firm*—Nixon & Vanderhye

(57) ABSTRACT

This invention is related to a smart balancing system, where it determines the steady or varying imbalance force vectors acting on rotational drum or rotors, while rotating at high speeds and counterbalances the said imbalance force vectors by using one or more "balancing drums" fitted onto the same drum or rotor along the same rotational axis and one of the areas where such a balancing system used, being high speed spinning washing machines, where the imbalance force vectors acting on the system while spinning at high speeds are eliminated by the use of said intelligent balancing system.

36 Claims, 9 Drawing Sheets

SMART BALANCING SYSTEM

A rotor, drum or similar system, rotating along one axis is usually a very important part of many machines. Such similar rotational parts exists in electric motors, various mills, fans, turbines, grinding machines, washing machines and many similar machines. In many machines, the balance is provided by adjusting the uniformity of the weight distribution of these rotational bodies along their rotational axis during manufacturing, where otherwise such an unbalance may cause unwanted vibrations in the machine which can even cause damage. But in some cases, the rotating part of the machine can be under the influence of varying imbalance forces. A washing machine spinning at high speeds, a grinding machine with worn out grind stone, a mill with unevenly worn parts are some examples of such machines. The said invention of the smart balancing system brings effective solution for such imbalance problems faced in these machines. A washing machine is chosen as an example in order to explain the said invention. The application of this invention for other machines will be similar to various washing machine types described below and therefore not explained in detail in this description.

In our present time, automatic washing machines are in use at homes, touristic locations, hospitals, residence homes, military organisations, organisations which provide professional cleaning services and many other areas. Besides the use of these machines for cleaning purposes, the use of such machines are continuously increasing in the textile industry for garment washing, stone washing and garment dying processes. Due to increasing capacities in the cleaning and textile industries, the number of machines to be used per unit area tends to increase and this encourages the washing machine manufacturers to design and manufacture larger capacity machines. Larger machines mean larger front loading doors and larger diameter wash drums. The larger diameter drums, spinning at high speeds creates new problems to be solved. Today, various washing machines are produced ranging from 4–6 Kg used in our homes, 6–150 Kg used in professional cleaning services and 100–500 Kg used in textile industry which are bedded with shafts either from one end or both ends of the rotating drum.

In rotary drum washing machines, high spin speeds are usually required in order to achieve efficient spinning results at around 300–400 g centrifugal forces. The factors which affect water extraction from garments in centrifugal spinning method are; drum diameter, drum rotation speed, the permeability and the temperature of the garments and the thickness of garments on the perforated surface of the drum. Efficiency in extracting water is not directly proportional with the increased centrifugal forces due to higher drum rotation speeds. Increasing centrifugal forces, on one hand, forces the mass of water towards the drum circumference but at the same time, it squeezes all the garments along the drum's inner surface and these wet textile fibres under this force forms a plastic type layer causing resistance against extracted water. It is more efficient to increase the inner drum surface area as this will reduce the garment thickness along the drum surface, causing better extraction. Increasing the inner drum surface usually results in deeper drum depths over longer rotational axis. The increased drum length makes it more difficult for the garments to be equally distributed against the inner drum surface which causes high imbalance along the rotational axis of the drum. Even if this is achieved, very small differences in weight distribution along the rotational axis causes damaging vibrations at high spin speeds. This imbalance problem is the major design criteria in high spin speed washing machines. Today's classic systems employs techniques where the drum assembly is placed on springs or air cushions and uses air or hydraulic type pressurised cylinders or shock absorbers in order to minimise the effects of vibration on the main body structure.

Another method of reducing the effects of vibration is to increase the weight of the mass, under the effects of acting imbalance forces. As a result, the mass which the imbalance forces has to move is increased, reducing the magnitude of vibration. This requires the use of additional weights on the total construction of the washing machine. These additional weights on the machine usually exceeds 50% of the normally required mechanical construction weight of the machine. Apart from this, the bearings used in order to connect this heavy mass of rotating mechanism to the main body construction has to be chosen larger than it should be necessary due to the high vibrational forces caused by the imbalance of the rotational system.

The vibration absorption systems used on the existing machines have limited use. By this reason, the garments have to be distributed along the inner drum surface as good as possible before the extraction process. In order to achieve this, the drum rotation speed first has to be increased to a level where the centrifugal forces just start to overcome the earth's gravitational forces. During this constant rotational speed or speed increase, the garments near to the inner surface of the drum sticks to the inner surface and starts to rotate together with the drum. As the garments, which cling to the drum as a result of the centrifugal forces stars to get pressed towards the inner surface, the cling diameter will be reduced gradually. When all the garments sticks to the inner surface and starts rotating with the drum, the distribution is said to be completed. If the garment distribution is not achieved properly, the extraction process will halt during spin process due to unacceptable vibration levels of the machine and the distribution process will commence again. These "re-starts" cause loss of time and energy as well as reduction in the machine capacity.

BACKGROUND OF THE INVENTION

Many balancing techniques have been developed so far for washing machines, in order to eliminate the unwanted inbalance forces. These are generally mechanical systems which make use of the acting imbalance forces. These systems introduced some improvements in small capacity machines but due to their complex construction, they required maintenance and increased the over all cost of the machine and therefore not widely used. The said mechanical balancing systems weren't also successfully applied for higher capacity industrial washing machines. U.S. Pat. No. 2,534,267/268/269, Kahn, U.S. Pat. No. 3,117,962, Starr's patents are some examples for the said balancing systems. The U.S. Pat. No. 5,280,660 Pellerin-Gaulter patent, which is most similar to the said invention in theory, has benefited from the ribs inside the rotating drum and tried to eliminate the imbalance forces by forcing water into these ribs through separate channels. This method divides the 360° of drum circumference into three locations with 120° apart and forces the correct amount of water into one or more ribs opposite to the imbalance force vector until this vector is eliminated. This balancing system has, to a great amount, solved the balancing problems in the larger industrial type washing machines and with the additional precautions, high speed spinning was achieved. But with this method, it was impossible to eliminate the balancing weights completely. The generated imbalance vectors can be at different points along the drum axis and the magnitude and direction can also vary. For drums with small depth/diameter ratio, the above mentioned method could provide satisfactory results but as the depth of the drum is increased, the imbalance becomes almost impossible to be compensated with the said method. Besides, the dynamic movements of the balancing fluid in the ribs itself causes varying imbalance weights in the system. With this method, the rotational axis of the drum must be highly horizontal. If this condition is not satisfied, the balancing fluid in the ribs will tend to collect to one side along the rotational axis in the ribs and cause further imbalance which will be difficult to compensate. The best method of balancing a rotational mass is to compensate the mass from both ends of its rotational axis. This way, an imbalance force vector formed along the rotational axis of the mass can be compensated with smaller counter-weights compared to its magnitude. Therefore, smaller counter-balance weights encountered at each end of the rotational axis can eliminate the imbalance of the drum. This is the only way to balance the system precisely. The better way of increasing the capacity of machines is to increase the depth/diameter ratio of the drum where such balancing problems of the said system is eliminated with the said method. The Pellerin-Gaulter balance system, in actual fact, utilises an older method of forcing balancing fluids into three separate equal volumes in the rotating drum independently through separate fluid canals and pipes. At present day, many applications of this idea is used, differing only in the way of control systems and sensing methods. But in the said new invention, the balancing method, the design of the balancing drum/drums and the method of injecting the balancing fluids into the balancing drums differ from the others to a great extend. The other systems require intelligent electronic control units which have to sense and calculate the direction and the magnitude of the imbalance vectors and determine the amount of balancing fluid to be forced into each particular rib. The cost of such control units will specially be significant for domestic type washing machines where competition and economics are at utmost importance. Another disadvantage of this balancing system by utilising such volumes in the drum is the loss of useful volume within the drum. Water naturally collects within these volumes during normal washing process. The chemical concentration in washing water is important during washing process. The amount water filled into these volumes means less chemical concentration and more energy use if heating is used. If the imbalance force vector is formed at such an angle so that the counter-balance weight has to lie in somewhere in between the two ribs, then balancing fluids have to be forced into both ribs. In this case, since the total resultant counter-balance force vector is the sum of the two force vectors of the two ribs in the opposite direction of the imbalance force vector, the magnitude of each of these force vectors have to be larger than the imbalance vector to be eliminated. The worst case condition is when the imbalance force vector is in the same direction with one of the ribs. In this case the counter-balance weight has to be in between the opposite two ribs, therefore equal amount of balancing fluids has to be forced into these two ribs. The counter-balance weight vector in the opposite direction of the imbalance force vector is half of the centrifugal force vector created. Therefore, the amount of balancing fluid mass to be forced into each corresponding rib has to be equal in magnitude to the imbalance force vector. In fact, only the same amount of mass needed to be inserted on the opposite direction of the imbalance force vector in order to eliminate it. Vector sum balancing method used in the washing machines requires twice the volume needed, in order to eliminate the imbalance weights. The balancing system described in the said invention uses both vector summing and direct opposite force vector method, therefore requires at least 50% less volume compared to the existing systems. Another requirement of these balancing systems is to keep the total washing times at optimum levels. After the washing process, the washing or rinsing water within these balance cells has to be released completely. At spin speeds, the imbalance of the rotational system has to be eliminated at the shortest possible times and after the spin process, the used balancing fluids has to be disposed without coming in contact with the washed garments. The balancing method to be developed should allow construction of any required size machine and should also be able to eliminate any kind of imbalance force vectors within the system.

SUMMARY OF THE INVENTION

The said dynamic balance invention allows the construction of any required size machine. In domestic washing machines, due to economical reasons, the system functioning makes use of the dynamic movements initiated by the acting imbalance forces. But in the industrial type washing machines, the cost savings on the machine construction due to balancing systems makes it feasible to use computers and sophisticated sensing systems for precise balancing results.

In the industrial washing machines, after the distribution process is completed, the balancing computing system starts monitoring the imbalance force vectors separately from both ends of the drum and determines the direction and the magnitude of the counter-balance force vectors to be created in the front and the rear dynamic balancing drums in order to eliminate the cause of imbalance in the system. Therefore the disorder of the weight distribution within the rotational system is eliminated and high rotational speeds will be possible without any problems.

On the load/unload side of the main drum, another cylindrical drum with a diameter greater or equal to the main drum is fitted. The name of this drum will be called as "balancing drum" here on, and only a small surface of the balancing drum is slotted open and it is divided into smaller cells or pockets of equal volume. The number of these cells/pockets can be increased according to the acceptable level of balancing, required in the machine. A second balancing drum similar to the one fitted on the front side of the main wash drum is also fitted on the rear side. A water jet system is also fitted exactly opposite to the slotted open inlet of each balancing drum units at each end. The balancing function computer control system determines the magnitude and the direction of the counter-balance weight to be created in each particular balancing drum and controls the balancing fluid injector valves in order to fill the correct amount of balancing fluid into particular balancing cells/pockets in the drum closer to the imbalance vectors to be eliminated by controlling the valves fitted on the pressurised balancing fluid pipes. The fluids entering the balancing cells/pockets will start to rotate together with the drum under the effect of the centrifugal forces. Therefore it is possible to balance the rotating drum independently from front and rear ends. There are two different types of valves used in the fluid injecting system. The computer system first uses the larger capacity valve or valves in order to roughly create the required counter-balance weights in the opposite direction of the imbalance forces to be eliminated. After reaching a lower level of balance, the smaller capacity valve or valves are used in order to complete the balancing action.

In case said invention is applied to the washing machines, there will be no need for extra weights used for reducing the effects of the imbalance forces on the machine and therefore the need for the springs, shock absorbers, air cushions and such similar systems will be reduced to a great extend. Also, since the high level of vibrations will not be acting any more, the need for over sized bearings, the drum shaft and the drum construction will be reduced and become more economical. As a result, the machine construction will be simpler and more economical than before.

DESCRIPTION OF THE INVENTION

The said invention of dynamic balancing system can equally be used in washer extractor machines as well as in extraction machines alone. This system can be applied to washing machines with single shaft, bedded with bearings from one end of the main rotating drum and also to machines with two shafts bedded with bearings on both end of the main rotating drum.

Figure 1:
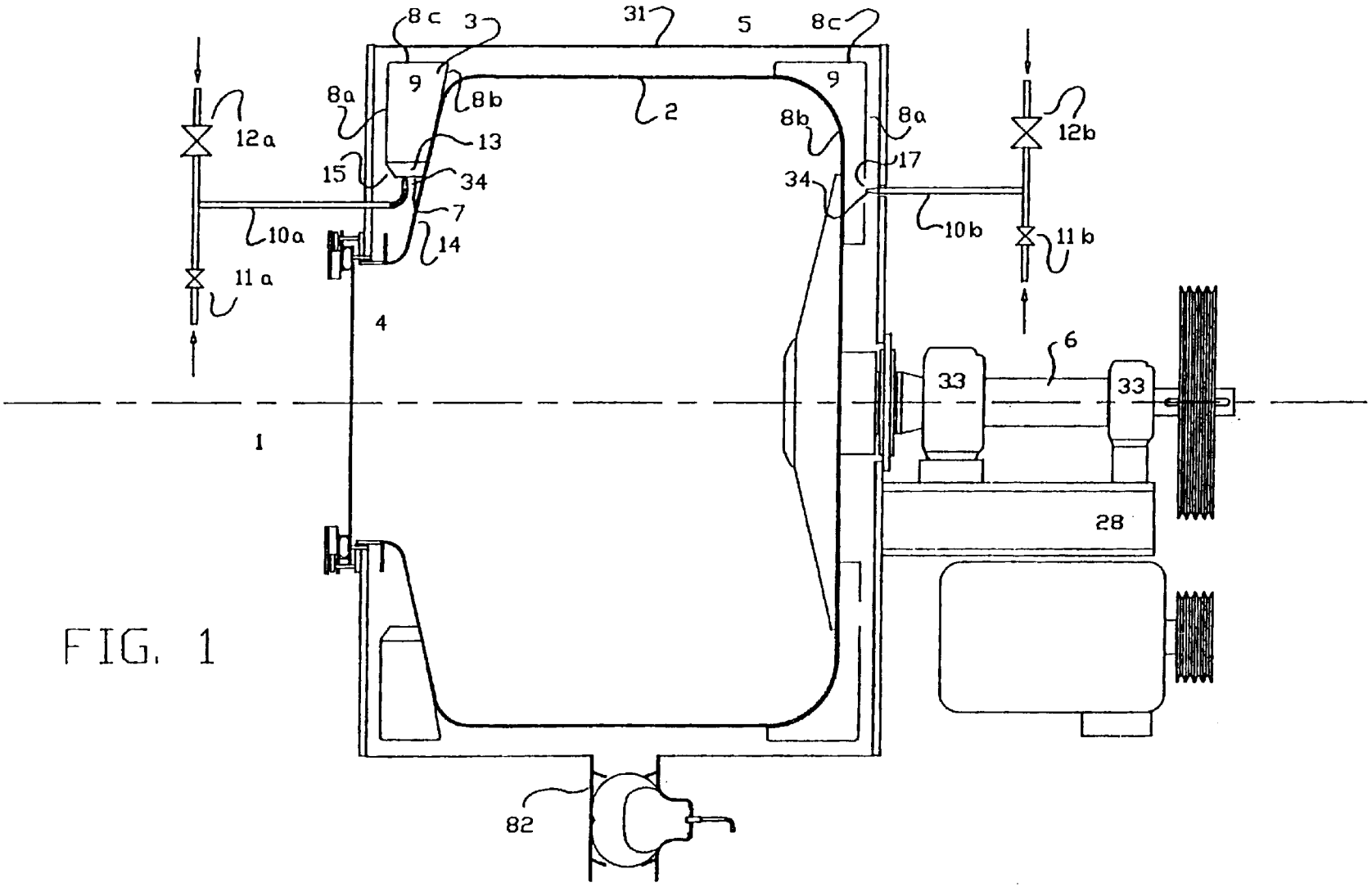
FIG. 1 is a longitudinal-sectional view in diagrammatic form of an industrial washing/extracting machine constructed in accordance with the present invention.
Figure 3:
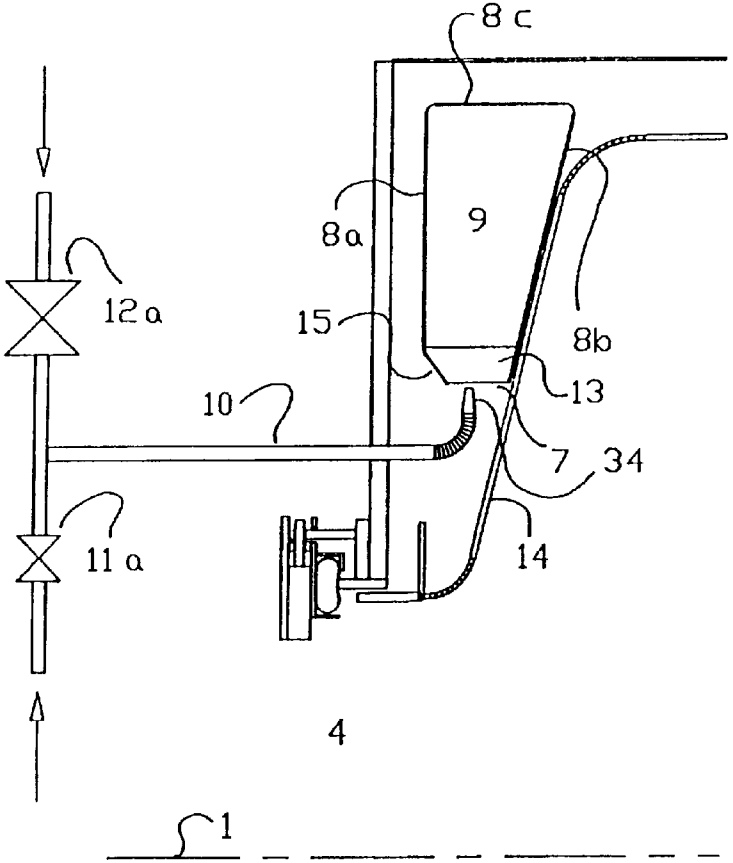
FIG. 3 is a longitudinal-sectional view in diagrammatic form of a first type balancing drum in accordance with the present invention.
Figure 2:
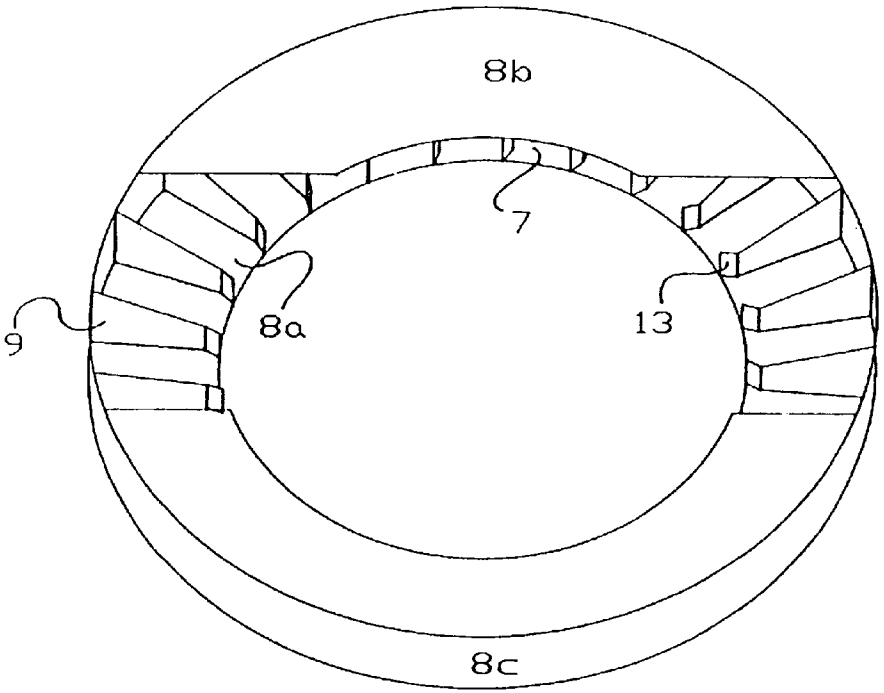
FIG. 2 is a front view in partial cross-sectional view of a first type balancing drum in accordance with the present invention.
Figure 4:
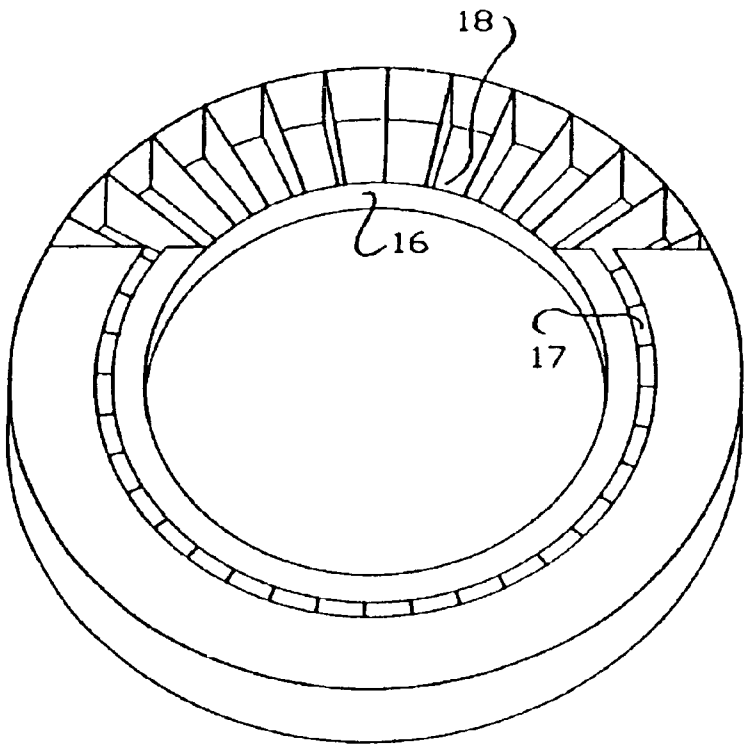
FIG. 4 is a front view in partial cross-sectional view of a second type balancing drum in accordance with the present invention.

The said system consists of two separate balancing drums, fitted on each side of a wash drum, having the same rotational axis (1) as the main wash drum (2) of the washing machine. In FIG. 1, a washing machine's side cross sectional view is shown in detail, with one balancing drum (3) fitted on the loading door (4) end of the wash drum and another balancing drum (5) fitted onto the rear shaft (6) end of the same wash drum. The balancing drums can have different shapes provided that they are based on the same concept. The balance drums are divided into smaller individual balancing cells or pockets depending on the capacity of the machine and the accepted level of imbalance. In FIG. 2 and FIG. 4, two differently designed balancing drum application examples are shown. In FIG. 2, a balancing drum is shown in detail where the balance cells or pockets are indicated with dashed lines on the facing front side, with all three sides **(8*a*, 8*b*, 8*c*) closed, except the side (7) facing the rotational axis of the drum and the fluid transfer between the cells or pockets is prevented by the separator plates (9) fitted vertically to the axis of rotation. The side cross sectional view of this balancing drum is shown in FIG. 3. A stationary fixed fluid injector (10*a*) is placed directly across the side facing the drum rotational axis is fed with pressurised water. One or more valves (11*a*, 12*a*) are fitted on this pressurised pipe, feeding this injector. The solid sides (8) apart from the one facing the rotation axis and the separator plates (9) form the balance cell or pocket. The example shown in FIG. 2 is formed from 24 cells or pockets. The balancing drums, which are going to be mounted according to machines' particular design characteristics, can be constructed with straight sides perpendicular (8*a*) to the rotation axis of the drum or it can be constructed with conical (8*b*) surfaces at an angle with the rotation axis or as well as no straight sides at all. In order to prevent unnecessary loss of volume in the outer drum housing, the sides of the balancing drum, as shown for rear balancing drum (5) in FIG. 1, can be shaped to fit drum's coupling side (8*b*). The cell separator panels can be mounted either perpendicular or at an angle to the rotation axis. If the separator panels (9) are mounted perpendicular to the rotation axis as shown in FIG. 2, then at the cell entrance open side, additional wings (13) with an angle towards the rotation direction has to be used. There are two reasons for additional angled wings or angled mounting of the separator panels. One reason is, while spinning at high speeds, the pressurised balancing fluid would not splash around when hits the cell wall and the other to be able to dispense the wash water or balancing fluid easily. If the said angled construction is avoided, the fluid pouring out of the cell or pocket during rotation of the drum may be filled into the next cell or pocket and it will be impossible to empty the water out of the balance cells or pockets. On the other hand, angled construction of the separator panels or use of additional angled wing plates will cause some of the water to be lifted above the rotation axis of the drum. From this point, the water dispensed from the cell or pocket will be carried out of the balancing drum's plane by use of conical side plates (8*b*), or if necessary, over the angled wings (14)** fitted at the opposite side of the cell entrance. To help disposing the water out of the balancing drum plane, an angled surface plate is also fitted at the open side of the balancing drum.

Figure 5:
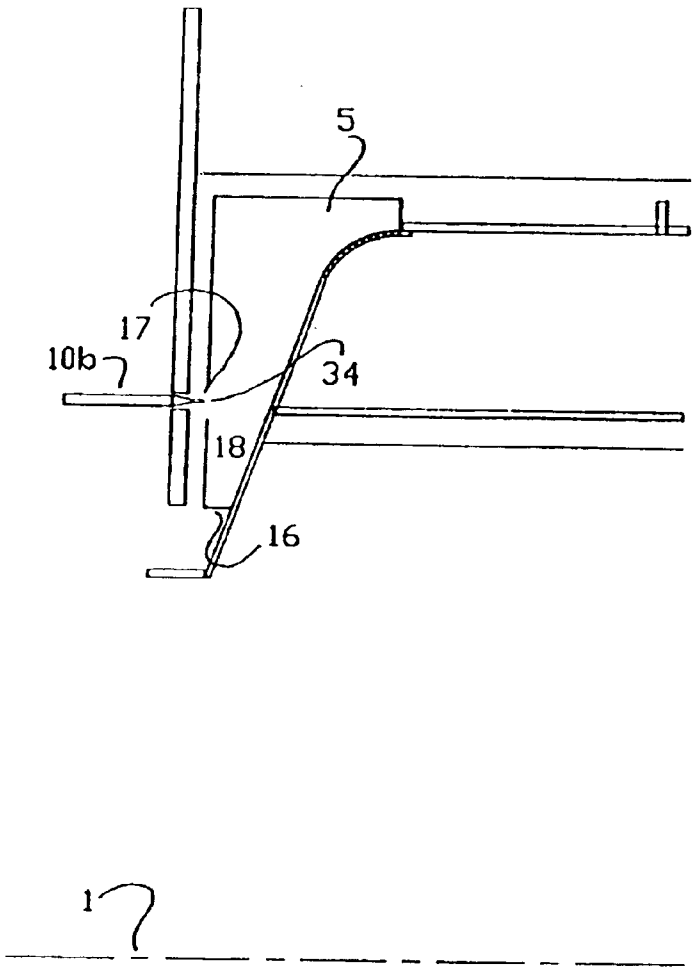
FIG. 5 is a longitudinal-sectional view in diagrammatic form of a second type balancing drum in accordance with the present invention.

The other balance drum design has a simpler construction compared to the design described above. One such balancing drum (5) is shown in FIG. 1 mounted at the shaft (6) end of the wash drum at the rear side. In FIG. 4, a front view of the said balancing drum is shown with balance cells as dashed lines, and in FIG. 5, a similar balancing drum mounted at the front end of the wash drum is shown. In the said balancing drum construction, the side (16), facing the drum rotation axis, is also closed as compared to the previously described balancing drum system. The outer opening of the balancing drum is constructed as an open slotted circle like doughnut shape (17) all along the front side of the balancing drum. The balancing water is injected into the balance cells or pockets through this slotted opening and also the disposal of the water is made from the same place. The water jets (10*b*) are placed opposite to the side of the balancing drum and the injected water under pressure enters the balance cell (18). The disposing of the balance water or the wash process water from these balance cells or pockets are achieved while cells are over horizontal level and therefore, the possibility of disposed water entering the adjacent cells does not exist.

Figure 6:
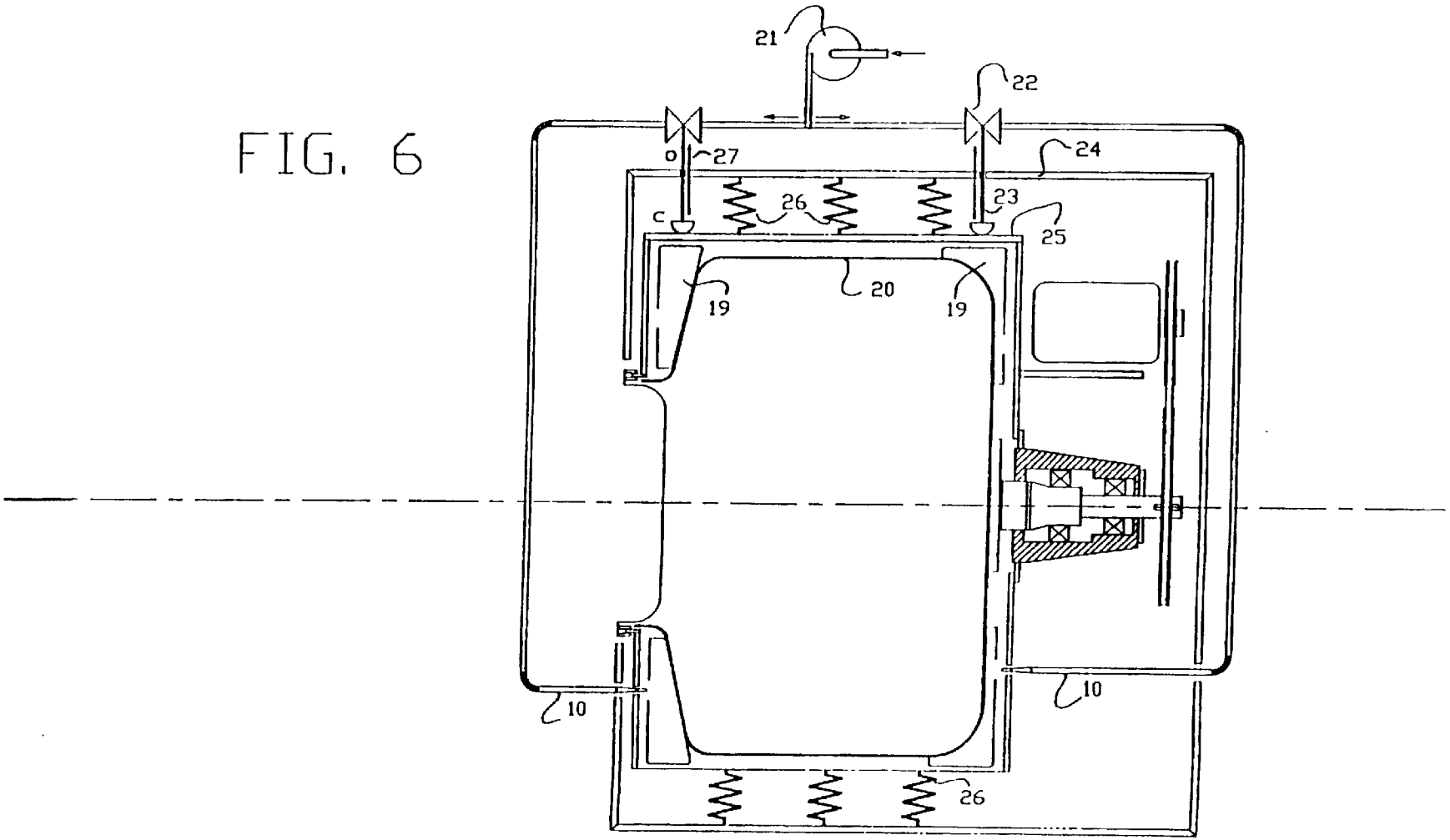
FIG. 6 is a longitudinal-sectional view in diagrammatic form of a domestic and laundry type washing/extracting machine constructed in accordance with the present invention.

The simplest application of the said invention is shown for domestic type washing machines as shown in FIG. 6. In this application, the balancing drums (19) to be mounted on the rear and front side of the wash drum (20) is specially designed and formed by dies which can be made from plastic or stainless steel. When the balancing action starts, a water pump (21) pressurises and conditions the water to be injected into the balance cells or pockets. The on/off control mechanism controls the said injector valve (22) and the balance water which is connected to the flexibly moving body of the wash drum mechanism (25) connected to the main machine construction via flexible fixtures (26). The physical movements caused by the imbalance forces on the flexible moving drum mechanism in the controlled axis will trigger the control mechanism (23) of the injector valve. The pressurised balancing water through the mechanical valve (22) is injected into the balance cells through the water jet (10) placed very close to the balance drum openings. Provided that the mechanical valve controlled by the physical movements of the flexibly moving drum mechanism under the effect of the imbalance forces and the water injector jet are placed at the correct axis and angle, it will be possible to counter-balance the system at the required speed. As an example shown in FIG. 6, the on/off control mechanism of the injector valve is placed in such a way that it will operate only when the imbalance movements are in 'y' axis. The valve will operate when the movements in the drum mechanism are in the positive direction of the 'y' axis and greater than zero or pre-determined magnitude. This situation shows the moment when the imbalance force which cause the system to move is in (+)y direction. In the figure, the (+)y direction movement of the drum mechanism is shown with an arrow (27). The water inject nozzle must be placed on the other side, that is to say in (−)y direction in order to be able to inject water in the cells directly opposite of the imbalance force vectors. When the imbalance movements in the drum mechanism in (+)y direction exceeds the accepted level of movement, the valve will open (o) and when it is below, the valve will close (c). In this way, the counter-balance weight is formed by injecting balancing fluid to the opposite direction of the imbalance force vectors which moves the drum mechanism. As the imbalance force is reduced, the magnitude of movements will start to reduce and the time for the valve to stay open will start to reduce and as a result, the number of cells filling with balance fluid will be reduced. When the imbalance force vector magnitude approaches the accepted limits, the open duration of the valve will be so small that only the cell directly opposite to the imbalance force vector will receive balancing fluid. The water injection into the cells will stop completely when the imbalance forces are below the accepted level of the machine because the movements will not be sufficient to trigger the valve mechanism. The above mentioned balancing method starts operating after the garments are distributed in the wash drum and lasted while the drum speed is controlled over a set period. Thus, while water is extracted from the garments in the drum, the balancing system will be active in order to compensate for the imbalance forces created.

As the capacity of the washing machines are increased, the systems employed for sensing and controlling of the balance action should become more accurate and work more efficiently.

As large capacity washer/extractor machines require a computer controller and related peripheral units in order to control the intelligent balancing system, the smaller machines between 2 to 25 Kg. capacities other means of control devices can be employed. One example of such simple control system is to control the fluid injector from a mechanism which is directly connected to the drum mechanism as described above. Another way of controlling the balancing system based on the same concept is to sense the movements of the drum assembly caused by the imbalance force vectors by means of special level switches, magnetic or hall effect switches or optical sensors and control the balancing fluid injection by solenoid valves through electrical signals. In this kind of machines, the balancing function is carried out at constant speeds depending on the diameter of the wash drum and the capacity of the machine. After distributing the load within the drum, the machine's control system increases the speed of the drum to a predetermined speed level and keeps the rotation speed constant. The injecting nozzle location is calculated and placed accurately in the way of imbalance force movement direction, depending on the angular difference of the trigger mechanism and the counter-balance weight direction and also compensated for the over-all system delays. If only one balancing drum is used, one trigger switch, correctly positioned according to the nozzle position is placed on the balancing drum front side of the machine where the contacts will be able to operate with the physical movements of the drum mechanism. The switch contacts directly controls the valves for the injectors. Therefore the movements of imbalance forces become direct control signals of the injector valve. The system operates as follows if we ignore the time delays. The drum mechanism follows a sinusoidal movement pattern due to the imbalance forces. When the imbalance force direction is directly opposite of the trigger switch, the drum sinusoidal movement is at its peak point. Therefore the water injector must be directly opposite of the trigger switch position. The switch mechanism has a spring actuator between the drum mechanism and the switch itself in order to absorb long strokes of the drum mechanism. Therefore the switch mechanism can be adjusted very close to the drum assembly. When the rotation speed of the drum reaches the required spin speed, the drum mechanism will start to move depending on the magnitude of the imbalance force vectors acting on the system. As the pattern of movement sweeps the direction of the control switch, it will trigger the injector valve depending on the distance from the drum mechanism and start to inject balancing fluid starting from that position. As the peak sinus movement is over, the drum starts moving away from the trigger switch and at one point the switch is completely released and the injector valve will be switched off completely. As the imbalance of the system is reduced, the magnitude of the sinusoidal movements will be reduced in proportion and the duration of the injector valve to stay "on" will also be reduced and this will cause less number of balance cells to be filled. As a result of this, the imbalance force will be reduced to a limit where it will not be able to trigger the control switch and the balancing function is completed. In this case the drum speed can be increased to the required level without any problem. In smaller capacity machines, one balancing drum fitted on one side of the wash drum may be sufficient while larger capacity machines require two balance drums along the rotational axis of the drum. The rib volumes in the wash drum of the washing machines can be connected together with the above said balancing drums to form counter-balance volumes. In this kind of application, if one balance drum is used, then the number of balance cells in the balance drum should either be equal to the number of ribs in the wash drum or twice as many. If the number is equal, then the ribs should lie in the middle of each balance cell. If required, the ribs can be divided into two equal volumes along their length and each volume of the rib can be connected to an individual balance cell. This way, economy can be achieved in small machines where precise balancing is not required. In the same way, when two balancing drums are used, the ribs can be divided into two volumes as required across their length and can be connected with corresponding balance cell from front and rear of the drum. If this system is applied to the above mentioned ribs divided along their axis, they will be divided into four volumes, two sections across and another two sections along their axis.

Figure 7:
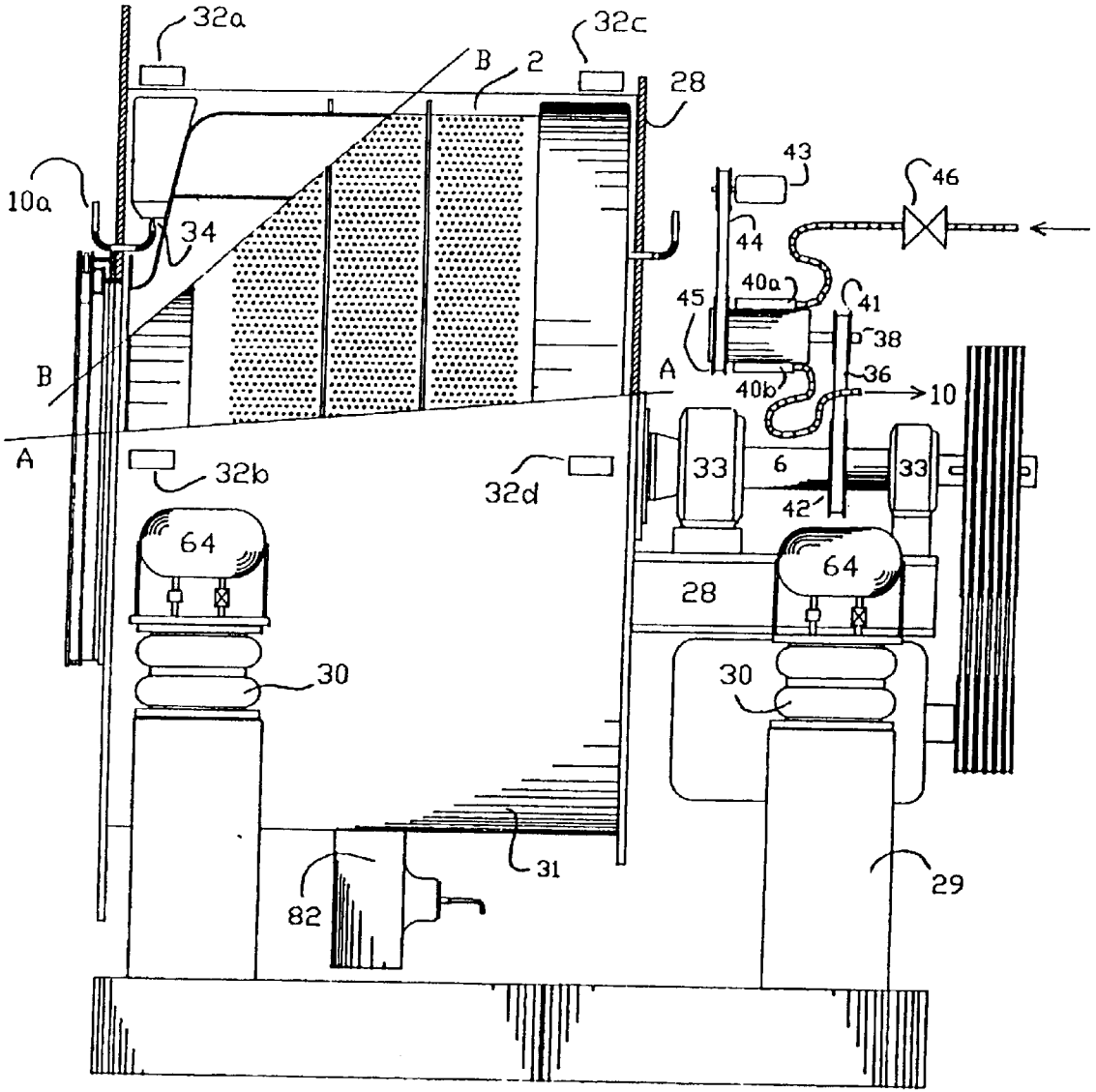
FIG. 7 is a side view with partial cross-sectional view in diagrammatic form of an industrial washing/extracting machine as seen along broken lines first A—A to reveal inner drum and second B—B to reveal sectional view of the inner drum and front side balancing drum.
Figure 9:
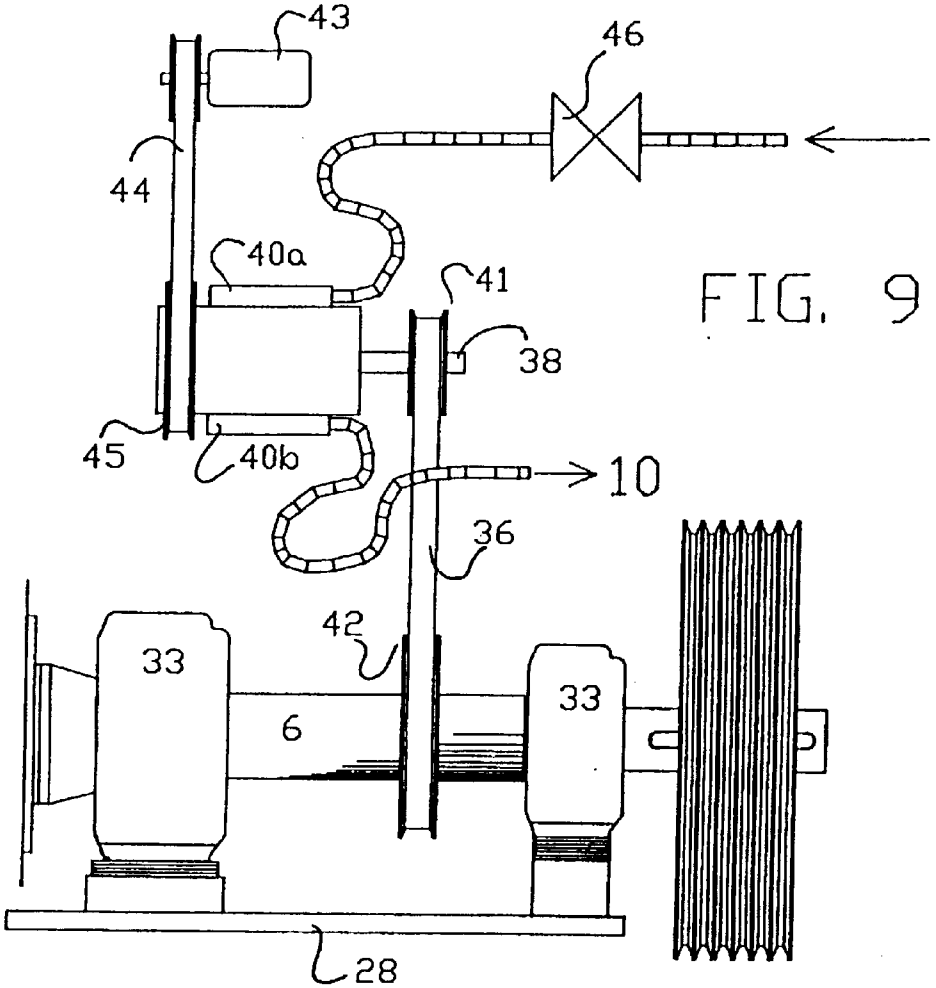
FIG. 9 is a diagrammatic form side view of complete system of the special balancing fluid valve.

The drum structure (28) which carries the drum beds is connected to the main body structure (29) via vibration absorbing materials like springs, air cushions or rubber blocks and even with flexible metal connections. FIG. 7 shows a washing machine drum construction on air bellows in drawing A—A and the cross section details of the drum in drawing B—B. As a result of flexible connection of the drum to the main body structure, the drum assembly follows sinusoidal physical movements due to the imbalance forces. The drum structure assembly (28), where the wash drum (2), and the drum housing (31) are connected with the system of a shaft (6) and the shaft bed (33), is connected to the main machine body structure with four movement sensors, like accelerometers, or sensors **(32*a*, 32*b*, 32*c*, 32*d*)** made for similar purposes with two in front and two in the rear of the drum structure assembly, determines the movements of this mass in two separate movement axis perpendicular to the rotational axis. These two axis are chosen as perpendicular to each other, thus, the movement information on two separate axis at the front and the rear of the drum structure assembly is fed to the computer and the magnitude and the direction of the acting imbalance force vector can then be determined.

In the control mechanism of the above mentioned balancing system, sensors **(32*a*, 32*b*, 32*c*, 32*d*) are used to determine the vibrations and the movements caused by the imbalance force vectors on the machine. The spin process starts after the wash process is completed in the washing machine. At the end of wash process, the waste water in the machine is released through the drain system (82) shown in FIG. 1**, and after distribution process, while increasing the drum speed, the connected sensors monitor the vibration of the system and continuously checks that the magnitude of the movements are below the predetermined signal levels. Another set of sensors in the balancing system, inductive, capacitive or optical, determines the speed of the wash drum together with an index reference point, and together with the signals from imbalance movement sensors, the magnitude and the direction of weight disturbance is calculated as a vector unit. If necessary, an incremental or absolute encoder, connected to the main drum shaft via trigger belt or chain helps determine the position of the wash drum.

Each machine has its own varying natural resonant frequency. It becomes more efficient when the balance control is activated at different speeds of resonance where the magnitude of movements are at maximum. The acceptable imbalance levels during operation of the machine are preprogrammed into the control unit and if the signals from the sensors increases above these acceptable levels, the control unit starts to inject balancing fluids into the balance cells or pockets directly opposite to the calculated imbalance force vector and this action continues until the detected imbalance force vector is eliminated. Since the balancing drums are connected directly to the main wash drum, with reference to the determined angle of the imbalance force vector, the amount of counter-balance weight is determined in angle and magnitude and the optimum distribution of this counter-balance weight along the balance cells are calculated. The computer unit which controls the balancing process continuously monitors all the variables which can effect this process (these are the mechanical delays, temperature and pressure, the over-all system weight or the tare weights). When the balancing process starts, the control unit injects a controlled amount of balancing fluid to a controlled position in the balance drums and checks the effect of these variables on the said process and if the result of this diagnostic test is valid, then the system constants are accepted as correct and these parameters will be used until the next balancing process starts. If these results are not valid in the next diagnostic test, the control system accepts a disturbance in the system variables and starts to test the peripheral units and the mechanical parts as well as the system variables. If the detected disturbance can be eliminated or compensated by the computer system, then this eliminated problem is given to the operator as an information but if the problem insists, then the control unit warns the operator and gives information about the existing problem on the display in order to reduce the maintenance time.

If the control system determines that the balancing process is progressing according to the predetermined conditions, the drum speed is slowly increased to a level programmed before-hand and at the same time monitors the signals received from the sensors. If the balancing fluid is injected at the correct position then the magnitude of the imbalance vector should be decreasing gradually and the control system monitors this. The balancing process continues until the magnitude of the imbalance forces are reduced below the maximum permissible level of the machine and when this point is reached, the normal spinning process continues, but if during the balancing process period, the monitored levels of imbalance do not drop below the initial values, the control system decides that there is a fault in the system and warns the operator before shutting the machine down.

The balancing fluid injectors **(10*a*, 10*b*) are placed as near to the balancing drum as possible. Depending on the determined angle and magnitude of the imbalance force vector, the correct amount of balancing fluid is injected in bursts through the fluid injector (11) or injectors (11, 12)** under the control of the balance control unit. The variance of balance during the balancing process period is monitored by the control unit via the signals from the sensors. Therefore, the movements of the drum at each end of the drum's rotation axis is caused by the imbalance force vectors are monitored by the control unit. The direction of the imbalance force vector detected by the sensors may not be at the same angle compared with the position of the injector nozzle therefore, the control unit calculates the angle difference to be compensated. This angle difference is then transposed to a certain time delay by the computer unit depending on the speed of rotation. As an example, if an imbalance vector is detected on one end of the drum at an angle of 0°, then the correct position of the balance cell where the counterbalance weight sould be added is 180° out of phase. But the position of the injector nozzle is at 90°. Therefore the balance water has to be injected with a delay of 90°. If we assume that the rotation speed of the drum is at 100 rpm during the balancing process, the period of one rotation is 600 mS and time delay reciprocal of 90° is equivalent to 150 mS and this value is calculated by the control unit. If the balance drum has 24 balance cells, then the duration of the injector to stay open in order to inject into the correct cell is 25 ms. In this case, the valve has to open with a delay of 150–12,5=137,5 ms and has to stay open for 25 ms. There will also be electrical, physical and mechanical delays from the instant of inject command and the fluid release from the nozzle. The computer unit has to take care of the said delay. The delay period is different for each system, but can also vary within the same system due to temperature and pressure fluctuations. The control system monitors the signals of sinusoidal movements of the drum structure caused by the imbalance forces. The control system operates the balancing process, a certain delay after the accepted vibration level of the machine is exceeded and will continue until a certain delay after the vibration level is reduced below the accepted level of the machine. The said delay time prior to balancing process is the sum of the calculated system delay time and the delay of the angular position between the sensor direction and the nozzle. The time delay of the angular difference is constant. The control system is programmed so that the delay time of the system can be determined by self calibration. The control unit determines this delay by measuring the response of the system to balancing action. Prior to self calibration, if the reduction in imbalance vector magnitude is monitored at constant angle difference, then the previous delay values are accepted to be correct. If the angle difference is not constant in spite of reduction in imbalance magnitude, then the delay constant has to be re-calibrated.

The control unit starts the balancing process at a constant rotation speed by monitoring the imbalance magnitude and direction at each end of the drum rotation axis, after the garment distribution process is completed. Initially, the rough balance has to be reached at the shortest possible time. For this purpose, the larger valves (12) with higher flow rates are used and because of their longer response times, balance fluids are injected into more than one balance cell in the opposite direction of imbalance vector. In a balance drum with 24 balance cells valve (11) is kept open long enough to inject balancing fluid into the balancing drum so that, the half of the balance drum, opposite to the imbalance force vector is filled with counter-balance weight to reduce the imbalance magnitude. By using more than one balance cell for the counterbalance weight shortens the time needed to reduce imbalance and also the balance cells are used more efficiently. Therefore, a certain balance level is reached by injecting some balance fluid into the necessary balance cells every drum rotation. As the reduction in imbalance is increased, the number of cells are reduced where balance fluid is injected. During the balance process, the control unit increases the speed of the drum within the limits of the imbalance forces that the machine's mechanical construction can withstand. As the speed is increased, the reaction of the remained imbalance will tend to increase as well. Therefore the speed is increased under control while the imbalance is reduced. After reaching a predetermined speed level, precise balancing process starts using the valves (11) with less flow rate and quicker response times. The response times of these valves are 6–8 ms and the said classic type solenoid valves are used for drum speeds up to 400 rpm. When 400 rpm drum speed is reached, the said classic type solenoid valves cannot be used any longer for balancing process due to their long response times of switching on and off. In actual case, the wet textile in the drum, which needed to be balanced due to its uneven distribution may not loose water proportional to its initial weight distribution. In this case, balance compensation will be required during the balance process due to the loss of water from the textile. Two different methods can be used;

In the first method, when the magnitude of imbalance forces exceeds the allowable limits of the machine specifications, the speed of the drum can be reduced down to the speed where faster valves can compensate for the loss in balance and then increasing the speed to previous level.

In the second method, much faster valves can be used which will allow the control system to monitor and compensate for the loss of balance at higher drum speeds.

Figure 8:
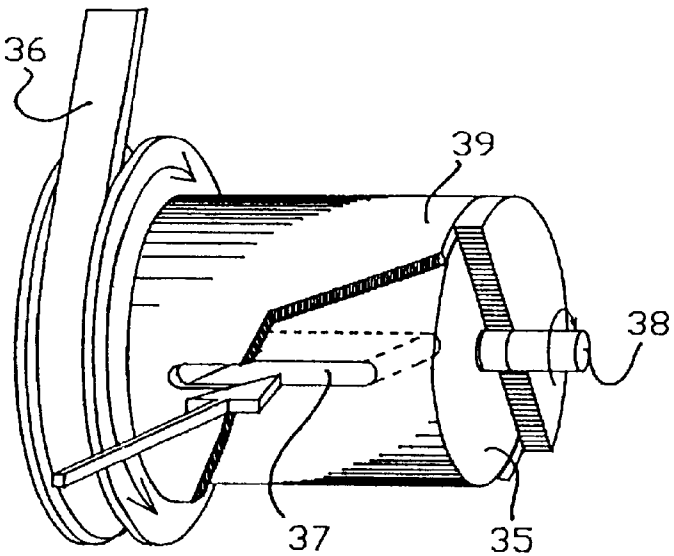
FIG. 8 is a side view of the special balancing liquid flow valve cut away to reveal the inner components in accordance with the present invention.

The mechanical valves connected to the drum body structure, suitable for use in domestic type washing machines as described before, can be utilised here in this case. Another special valve to operate in synchronism with the rotating drum and suitable for injecting balance fluids at high drum speeds is specially designed. (FIG. 8) The valve's rotational cylindrical centre (35), which serves as the on/off control of the valve is directly connected to the drum shaft (6) via a trigger belt (36), a pulley (42) system as shown in FIG. 8. As the speed of the drum is increased, the required periods for fluid injection has to be reduced and since the on period of the valve is shortened, this increases the resolution. The said valve consists of cylindrical outer body (39) and bedded (38) rotational inner drum (35) with a row of holes or a slot opening (37) perpendicular to its rotational axis. The outer cylindrical body has also holes or a slotted opening **(40*a*, 40*b*) to match the holes on the inner drum. The inner drum of the valve rotates as directly connected to the main wash drum assembly and half the speed of the wash drum. In order to achieve speed reduction in the valve drum, the drive pulley (42) diameter of the valve is twice the size of the pulley (41)** on the wash drum shaft. Because the holes in the inner drum opens and closes the valve twice every rotation, switching on, in the same period with the wash drum is provided. The ratio of the diameter of the holes or the slot opening, to the circumference of the total inner drum of the valve is equal to 1/(balance cell number)*2. Therefore, the time of opening of the valve when the the holes coincide is equal to the time of one cell to pass in front of the nozzle. The outer cylinder is also made to rotate by a stepper motor (43) over 360° under the control of the computer control system. The outer cylinder movement of the valve can be achieved by a belt (44) and a pulley (45) as well as a chain or a directly coupled cogs. The system changes the position or angle of the outer cylinder and adjusts it according to the position of the balance cell to be filled. It also takes the system delays into consideration. When the outer cylinder is in correct position, the solenoid (46) which allows the water into this valve is opened. The fluid with the pressure raised to 10–12 bars by a special pressurising system reaches to the correct balance cell every rotation of the drum, synchronised to the speed of the main drum. With this method, balance compensation can be provided at high drum speeds during spinning of the load. One other method of injecting balancing fluid into the balance cells is to use separate water channels which is used in many balancing systems up to date. It is possible to transfer the injected fluid into the required balance cell with this method, through channels formed in circles, placed anywhere on the rotating system, with the rotation axis as the rotation axis of the drum. If individual water channels are placed inside or outside of the drum housing, as many as the total number of balance cells in the front and the rear balance drums, then if a counter balance weight is required in a balance cell, it will be sufficient to inject fluid into the corresponding channel. The said channels are completely sealed apart from the sides facing their rotation axis and only connected with the balance cell that it is related with. Therefore the fluid injected into these channels is forced to the outer surface, which is leak proof, due to the centrifugal force and goes into the balance cell that it is connected with.

Figure 10:
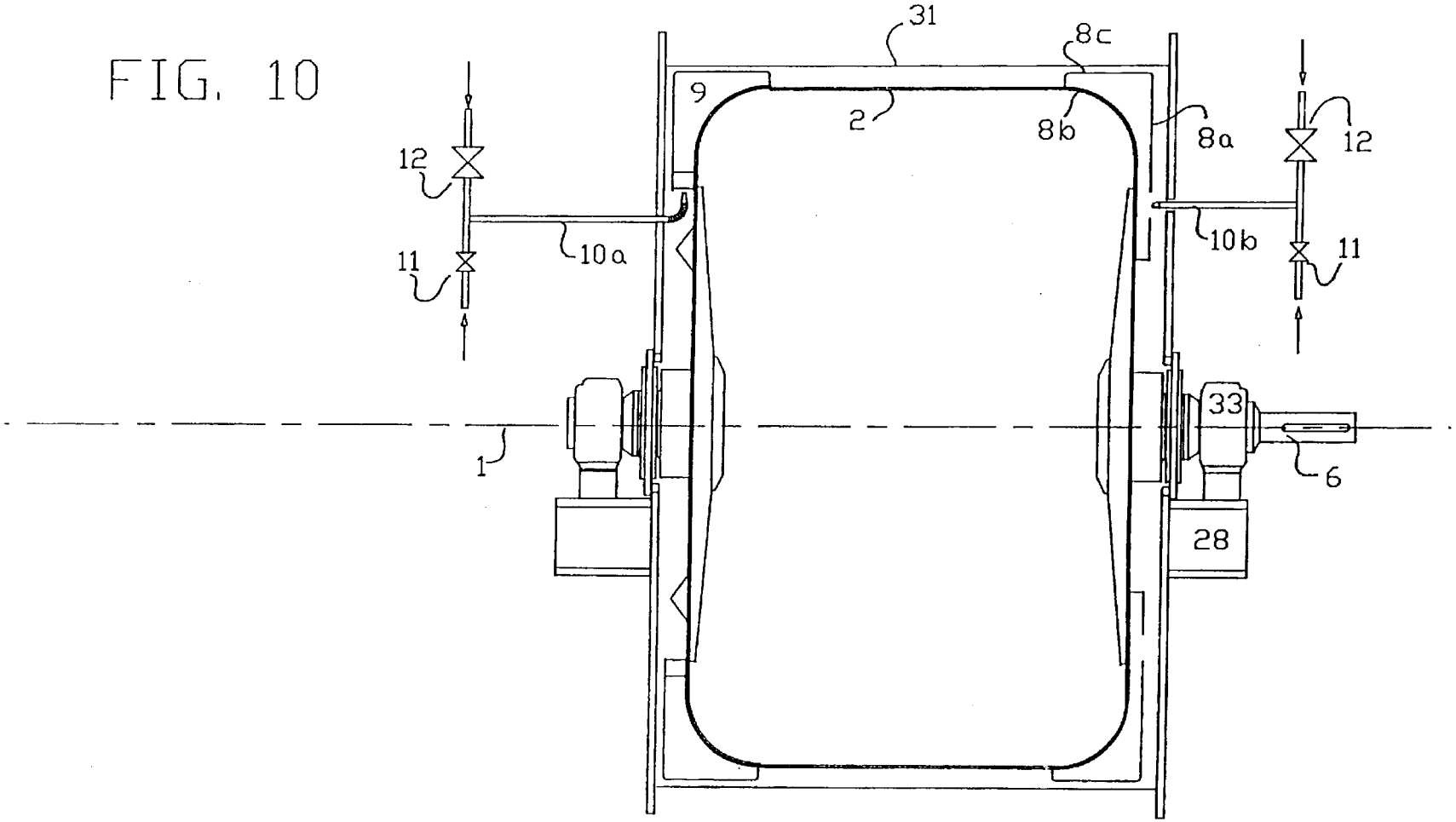
FIG. 10 is a longitudinal-sectional view in diagrammatic form of an horizontal axis double side bedded drum type industrial washing/extracting machine constructed in accordance with the present invention.

The intelligent balancing system, apart from machines with single bedding from one side of the drum, can also be used for machines with bedding from both sides of the drum and where the garment load/unload is made through the openings on the curved sides of the wash drum. The balancing drum can be applied to both ends of the wash drum, as applied to one side as described above in FIG. 10, an application of the said system to a machine bedded on both ends of the drum is shown. The working principle of the system is the same as single side bedded drum principle.

Figure 11:
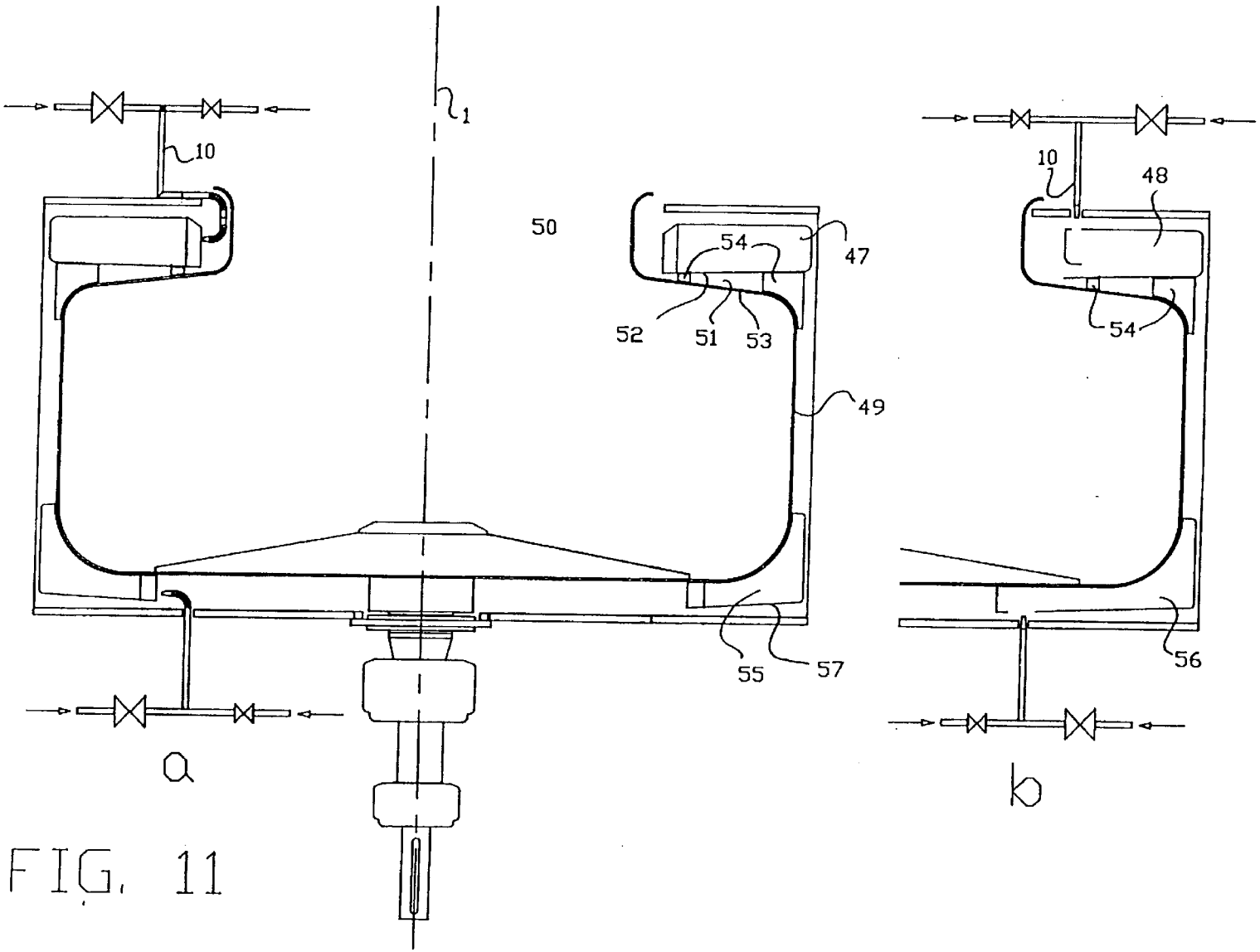
FIG. 11 is a longitudinal-sectional view in diagrammatic form of an vertical axis bottom side bedded drum type industrial extracting machine constructed in accordance with the present invention.

Another application area of the intelligent balancing system is the vertical mounted extractor machines. The balancing is a serious problem on these machines too. Therefore the said invention is an important solution for these machines as well. Because these machines are mounted vertically, the placement of the balancing drums must differ from the machines that work on horizontal mounted drum axis. One important reason for the difference is to dispose the balancing fluid out of the balancing drum without wetting the garments, after the spinning process is completed. In FIG. 11, an example of the said dynamic balancing system is shown as applied to the drum (49) of a vertically mounted extraction (high speed spinning) machine. The load/unload door (50) of the drum is facing up-wards. In case balancing drum is applied to the main drum, the balancing drum (47) must be mounted at the load/unload end of the drum. In this application, the balancing drum is not completely sealed with the wash drum as it was the case with washing machines. There is a slight gap (51) in between. The balancing water, which rotates together with the balancing drum due to the centrifugal forces during the balancing process, will slowly start to pour down the conical sides (52) of the balancing drum which is inclined downwards, as the drum starts slow down after spinning process and the earth's gravitational force starts to overcome the centrifugal forces, and from the main drum's conical surface (53) down the drum and empties the balancing drums. The balancing drum is connected to the main drum with fixtures (54) so as to leave a slight gap. While the said dynamic balancing system can be applied to smaller capacity extractors with one single balancing drum, the larger capacity extractor machines will require two separate balancing drums to be fitted at each end of the main drum, because it becomes impossible to balance the system due to the formation of different imbalance force vectors along the rotational axis of the drum. In this case, the second balancing drum (55) is mounted at the bottom end of the main drum as to join the drum surface completely. It is much easier to empty the water out of this balance drum compared to the one fitted to the top of the drum. The only thing to do is to construct the lower surface of the balancing drum (57) slightly conical at the entrance of the drum slotting and as the drum speed is reduced, the balancing water will drain out over this conical surface. Apart from this, the balancing process is exactly the same as in the washing machines.

The balancing drums to be used in the washing machines can be made in many different shapes, using many different materials. The balancing drums for the domestic type washing machines can be produced from plastic specially moulded and fixed to the stainless steel washing drum or it could be shaped with a die out of stainless steel. As the machine capacities are increased, it becomes more difficult to apply single piece plastic or stainless steel forms using die casts. In this case, the balancing drum can be constructed from many separate pieces where each piece can be made from plastic or metal and then put together to form the balancing drum. Various plastic production techniques can be utilised for the production of the balance cells. Plastic cells or pockets can be produced by injection moulding, expansion, or plastic welding methods and metal cells or pockets can also be produced in order to form the balance drum.

Another application method of the balance system is to mount the balancing drums out of the wash drum housing. In machines where the drum assembly is bedded from one side, it is only possible to mount the balancing drum out of the drum housing at the shaft end, while in the machines where the drum is bedded from both ends, both of the balancing drums can be mounted out of the drum housing. As this method makes the machine's construction more difficult, the required volume for these balancing drums in the drum housing is eliminated and therefore it will be economical in the long run, due to the reduction in water used and hence reduction in detergent and heating energy. Another advantage of this application is that, the required amount of counter balance weight to be used in the balancing cells at each end of the drum along the rotational axis is reduced as moved away from the location of the imbalance vector position. The shaft drive pulley is fitted at the far end of the drum shaft, and as the balancing drum can be mounted anywhere along this shaft, it can also become the drive pulley of the drum. In this case, the size of the balancing drum located at the far end of the drum shaft will be smaller than the balancing drum used in the drum housing at the shaft end.

Figure 12:
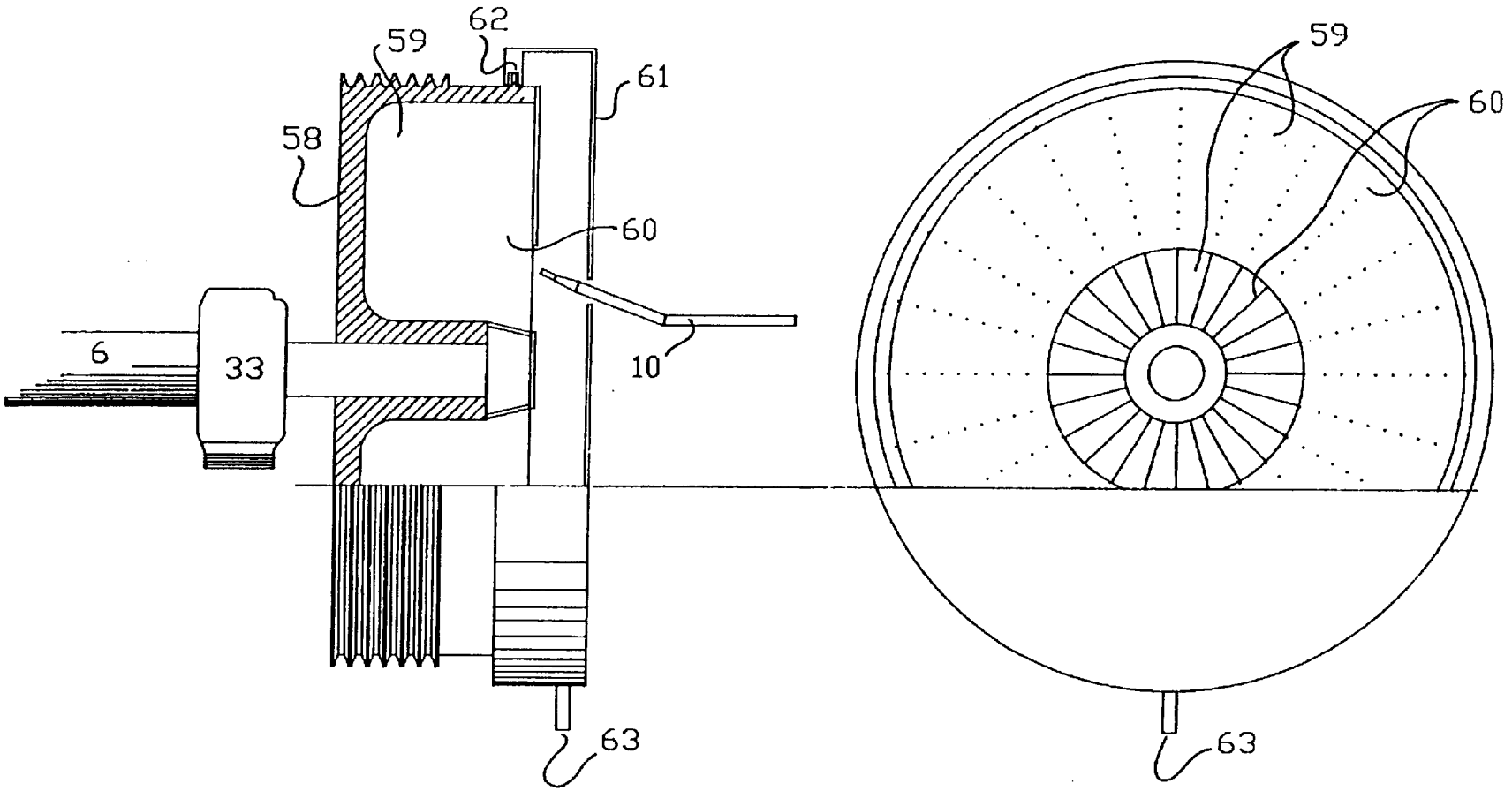
FIG. 12 is a side and front view of the main drive pulley at the back of the main drum shaft designed as balancing drum cut away to reveal the inner balancing compartments in accordance with the present invention.

FIG. 12, shows the use of the rear drive pulley (58) as a balancing drum. 24 balancing cells (59) are constructed in the drive pulley. The balance cells are constructed in the drive pulley by using separation plates perpendicular to the balance drum. While the balancing fluid is dispensed easily into the drum housing when the balancing drum is fitted in the drum housing as part of the drum, in the application where the balancing drum is part of the rear drive pulley, the back end of the pulley is closed with a lid (61) in order to dispense the balancing fluid without splashing, out of the system. A flange on the drive pulley (62) rotates in a channel in the said lid and prevents the water to leak out. The injector nozzle (10) mounted onto the stationary lid directly lies across the open ends of the balance cells. The water reached the lid is disposed through a drain pipe (63) out of the system. Since the said balance drum is out of the wash drum housing, another balance fluid can be used apart from water. In this case the system can be used as a closed system. The balancing fluid can be pumped from a tank and used for the balancing process and then this fluid can be transferred back to the tank for reuse. In this case one of the important fluids to be used as balancing fluid is the hydraulic system oils. It has many advantages apart from the disadvantage of having a lower density than 1 which means an increase in balance volumes but it is possible to make use of many accessories for hydraulics. The flow rate of the balancing fluid during the balancing process is important for short balance times. It is very easy and economical to install such system outside the machine which makes use of hydraulic oil, high pressure hydraulic pumps, seals, and a large choice of valves. Since the hydraulic is not corrosive, stainless steel and antirust materials are no longer required for system construction and this is economical. The balance system which can be adapted to the shafts, can be used for any kind of machines with bearing from one end or both ends with variable imbalance problems. All machines facing imbalance problems can be balanced with two balancing drums placed properly on both sides of the rotating system and it is possible to compensate these vibrations by monitoring the vibration levels when necessary.

What is claimed is:

1. A machine comprising:

a drum or rotor rotatable about an axis;

at least one balancing drum carried for rotation therewith about said axis and carrying a plurality of balance cells each having an opening;

said balancing drum having at least three balance cells having equal volumes;

at least one sensor carried by said machine for determining a magnitude and direction of imbalance vectors acting on the rotatable drum during rotation thereof, said rotatable drum and said balancing drum being flexibly mounted on a main body structure;

a nozzle positioned to face the openings of said balance cells for injecting a pressurized balancing fluid into one or more balance cells selected from said plurality thereof;

a pump for pumping the balancing fluid through said nozzle; and at least one valve for controlling the flow of balancing fluid through said nozzle in accordance with the determined magnitude and direction of the imbalance vectors.

2. A machine according to claim 1 wherein said balance cells have openings facing the axis of rotation, said cells being otherwise closed;

said cells having at least one wall defining each opening at an angle relative to a radius of the axis of rotation.

3. A machine according to claim 1 wherein said balancing drum has an annular surface, said cell openings opening through said annular surface and being otherwise closed.

4. A machine according to claim 1 including at least one balancing fluid injector system for said balancing drum, said at least one fluid flow control valve forming part of said injector system, a pipe in communication with said nozzle to accelerate a fluid from said control valve through said nozzle, said control valve in the balancing system being precisely controlled such that a required magnitude of balancing fluid in injected into a required position of the balancing drum during balancing operation.

5. A machine according to claim 1 including a second balancing drum carried by said rotatable drum for rotation therewith about said axis and carrying a plurality of second balance cells each having an opening;

a second nozzle positioned to face the openings of the second balance cells of said second balancing drum for injecting a pressurized balancing fluid into one or more second balance cells selected from said plurality thereof in accordance with the determined magnitude and direction of the imbalance vectors, and a second valve in communication with said pump for controlling the flow of balancing fluid through said second nozzle into the second balance cells in accordance with the determined magnitude and direction of the imbalance vectors.

6. A machine according to claim 5 including separate injector systems for the balance cells of each of the first and second balancing drums, each said balancing drum having an annular surface, said cell openings opening through said annular surface and being otherwise closed;

each said injector system including a narrow passage opening into each cell and rotatable with the balancing drum;

said valves forming respective parts of the injector systems for controlling the fluid flow injected into the passages of the balance cells.

7. A machine according to claim 6 wherein the rotatable drum is flexibly supported from said main body structure by blocks formed of a flexible material.

8. A machine according to claim 1 including a control system including controllers for calculating the magnitude and direction of the imbalance vectors in response to said sensors and determining the magnitude of counterweight balancing fluid to be injected into the one or more balance cells of the balancing drum in response thereto to balance the machine.

9. A machine according to claim 8 wherein said machine is a washing machine used for textile and garment washing.

10. A machine according to claim 9 wherein the rotatable drum is supported by a flexible material.

11. A machine according to claim 8 wherein said machine is a dyeing machine for textile garment dyeing.

12. A machine according to claim 8 wherein said machine is a stonewash machine.

13. A machine according to claim 8 wherein the rotatable drum is flexibly supported from said fixed mounting structure by gas pressurized rubber bellows.

14. A machine according to claim 1 wherein the rotatable drum is flexibly supported by suspension springs relative to said main body structure.

15. A machine according to claim 8 wherein the rotatable axis of the drum is horizontal, said balance cells having separator plates angled in the direction of rotation.

16. A machine according to claim 8 wherein said rotatable drum is mounted for rotation about a vertical axis and has a loading door adjacent an upper end thereof, said balancing drum being carried by the rotatable drum for rotation therewith about said vertical axis and above the upper end thereof, said rotatable drum and said balancing drum having a gap therebetween enabling outflow of balancing fluid from the balance cells of said balancing drum said balancing drum having a lower inclined side enabling balancing fluid to flow toward the rotational axis of the rotatable drum, an upper side of said rotatable drum facing the lower inclined side of the balancing drum being inclined away from the axis, enabling the balancing fluid to move in a direction away from the rotational axis toward the outside of the rotatable drum.

17. A machine according to claim 16 including a second balancing drum, said second balancing drum being carried adjacent the bottom of the drum, a bottom side of the second balancing drum being inclined toward the axis, enabling the balancing fluid to move toward the rotational axis.

18. A machine according to claim 1 wherein said rotatable drum has a plurality of ribs, the number of balance cells being at least equal to the number of ribs in the rotatable drum, each said balancing cell sharing the same volume as its corresponding rib.

19. A machine according to claim 1 wherein the rotatable drum has a plurality of ribs, the number of balance cells being twice the number of ribs, each said rib being located between two balance cells separated by a common plate therebetween.

20. A machine according to claim 1 wherein the rotatable drum has a plurality of ribs, the number of balance cells being twice the number of ribs, the ribs in the direction of the rotatable axis being divided into two equal parts forming equal balancing cell volumes along axially spaced ends of the machine.

21. A machine according to claim 1 wherein said rotatable drum includes a loading side door and is mounted on the main body structure by two bearings on one side of the drum, said balancing drum being mounted on the rotatable drum and located adjacent the loading side door with one side shaped to fit the shape of the rotatable drum or mounted integral with one side of the rotatable drum.

22. A machine according to claim 21 including a second balancing drum mounted on the rotatable drum on an opposite side thereof from the first-mentioned balancing drum.

23. A machine according to claim 21 wherein said rotatable drum is mounted on a shaft carried by said two bearings, a second balancing drum located external to and rotatable about the axis of rotation of the rotatable drum, said second balancing drum being rotatably mounted in a leak-preventing outer housing drum to maintain the balancing fluid in the machine.

24. A machine according to claim 1 wherein said rotatable drum is mounted for rotation about its axis on the main body structure with two bearings on a shaft on one side of the rotatable drum, said one balancing drum being mounted on the main rotatable drum, said balancing drum being placed on the shaft side and having one side shaped to correspond to the shape of the rotatable drum and fixed or mounted to share a common side as the rotatable drum.

25. A machine according to claim 1 including a rotatable drum housing having bearings on two separate shafts on opposite sides thereof, a second balancing drum, said first-mentioned and second balancing drums being located adjacent each end of the rotatable drum inside the drum housing on said shafts, respectively.

26. A machine according to claim 1 including a rotatable drum housing having bearings on two separate shafts on opposite sides thereof, a second balancing drum, said first-mentioned and second balancing drums being located adjacent each side of the rotatable drum shafts and outside the drum housing, each said balancing drum having an outer housing drum attached to the main body structure to maintain the balancing fluids in the machine, said balancing drum housings having drains for draining the balancing fluid.

27. A machine according to claim 1 wherein said rotatable drum is mounted on a shaft carried by a bearing mounted on said main body structure, a drive pulley for rotating the drum shaft, said balancing drum being carried on said drive pulley outside of the rotatable drum.

28. A machine according to claim 27 wherein the balancing fluid comprises hydraulic oil.

29. A machine according to claim 1 wherein the sensor includes an accelerometer.

30. A machine according to claim 1 wherein said sensor includes a mechanical or electromechanical switch and said rotatable drum includes a drum housing, said switch being mounted on the main body structure and imbalance movements of the drum housing being conveyed to said switch through said drum housing to provide electrical output signals responsive thereto, said valve being responsive to electrical output signals from said switch for controlling opening and closing movement of said valve.

31. A machine according to claim 1 wherein said valve comprises a solenoid-actuated valve.

32. A machine according to claim 1 wherein said valve includes an inner element rotatable within an outer body, a transfer mechanism coupling said inner element and a shaft mounting said rotatable drum for rotating said inner element at one-half the speed of rotation of the shaft, said inner element having balancing fluid flow holes, the diametrical size of the holes being equal to the ratio of the circumference of the inner drum divided by the total number of balance cells to the number of balance cells required to receive the balancing fluid for a given imbalance, said outer body having holes for periodic registration with the holes of the inner element upon rotation thereof and connected to a supply of pressurized balancing fluid and the valve, a control for rotating said outer body in accordance with the one or more balance cells to receive the balancing fluid.

33. A machine according to claim 1 including a drive for rotating, accelerating and decelerating said rotatable drum, said valve being operable to balance the rotatable drum during acceleration or deceleration thereof.

34. A machine according to claim 1 including a drive for rotating the drum at constant speed, said valve being operable to balance the rotatable drum while driven at constant speed.

35. A machine comprising:

a rotational drum assembly including an inner drum and main shaft for pivotable mounting about a rotational axis and carried by a main body structure;

a balancing drum carried for rotation with said rotatable drum and having discrete balance cells thereabout;

flexible fixtures interconnecting the rotational drum assembly and the main body structure enabling movement of the rotational drum due to imbalance forces to be transferred to the main body structure;

a balancing fluid system connected to a pressurized control unit and including a balancing fluid injector valve mounted onto the main body structure; and a control system for opening and closing the injector valve in accordance with the movements of the rotational drum assembly caused by the imbalance forces to supply balancing fluid to one or more of said balance cells to counteract the imbalance forces.

36. A machine according to claim 35 including a second balancing drum carried by the rotatable drum and having discrete second balance cells thereabout, a second balancing fluid injector valve mounted on the main body structure of said machine, said control system adapted to open and close the second injector valve in accordance with the movements of the rotatable drum assembly caused by the imbalance forces to supply balancing fluid to one or more of said second balance cells to counteract the imbalance forces.

* * * * *

UNITED STATES PATENT AND TRADEMARK OFFICE

CERTIFICATE OF CORRECTION

PATENT NO. : 6,510,715 B1
DATED : January 28, 2003
INVENTOR(S) : Tulga Simsek

It is certified that error appears in the above-identified patent and that said Letters Patent is hereby corrected as shown below:

Title page,
Item [76], the inventor's address should be corrected to -- 2038/3 Sokak No. 36, Atakent Bostanli, 35540 Izmir, Turkey --

Signed and Sealed this

Twenty-ninth Day of July, 2003

JAMES E. ROGAN
*Director of the United States Patent and Trademark Office*